US005638783A

United States Patent [19]

Regueiro

[11] Patent Number: 5,638,783

[45] Date of Patent: Jun. 17, 1997

[54] VALVE TRAIN FOR AN INTERNAL COMBUSTION ENGINE

[75] Inventor: Jose F. Regueiro, Rochester Hills, Mich.

[73] Assignee: Chrysler Corporation, Auburn Hills, Mich.

[21] Appl. No.: 578,369

[22] Filed: Dec. 26, 1995

[51] Int. Cl.[6] ..... F01L 1/26

[52] U.S. Cl. ..... 123/90.22; 123/90.27; 123/90.4

[58] Field of Search ..... 123/90.22, 90.23, 123/90.27, 90.39, 90.4

[56] References Cited

U.S. PATENT DOCUMENTS 4,327,677 5/1982 Vander Bok ..... 123/90.22

4,924,821 5/1990 Teerman ..... 123/90.22

5,303,680 4/1994 Nielsen ..... 123/90.22

5,570,665 11/1996 Regueiro ..... 123/90.27

*Primary Examiner*—Weilun Lo

*Attorney, Agent, or Firm*—Kenneth H. MacLean

[57] ABSTRACT

A valve train mechanism for an internal combustion engine that includes angulated intake valves and exhaust valves extending from a curved upper wall of the combustion chamber and having a cross member provided with a roller and groove arrangement for directly actuating inverted bucket tappets associated with the intake and exhaust valves.

10 Claims, 5 Drawing Sheets

FIG-2
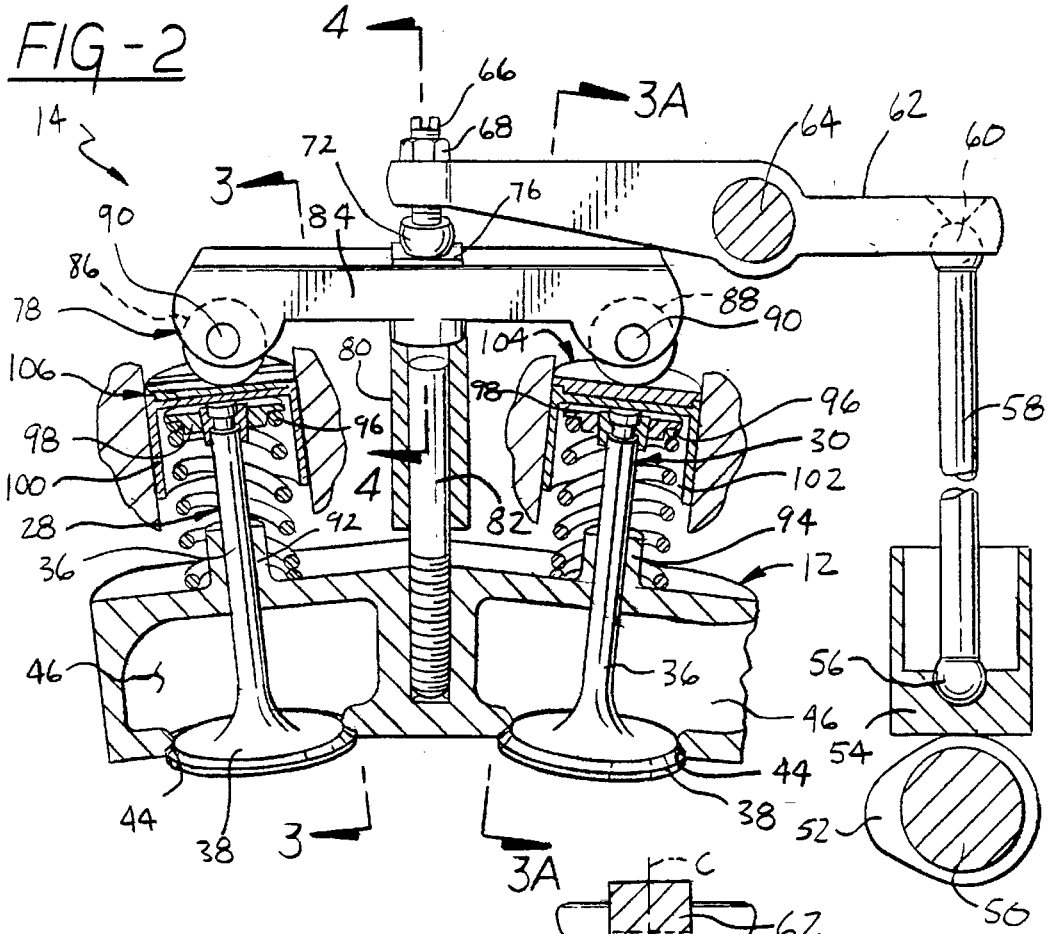
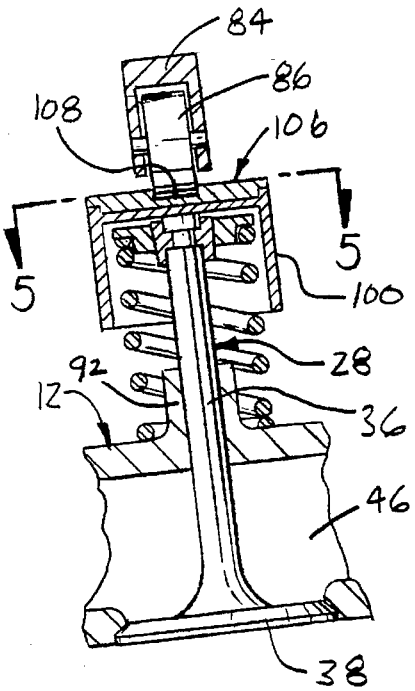
FIG-3
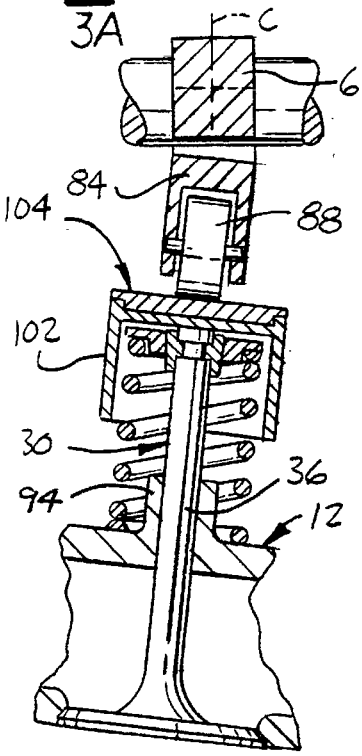
FIG-3A
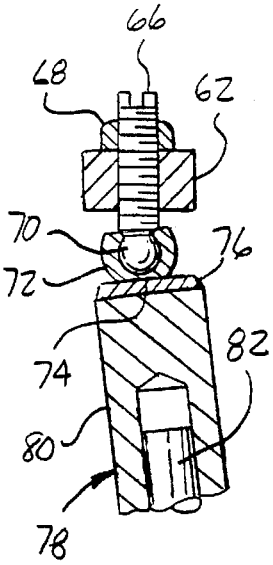
FIG-4

VALVE TRAIN FOR AN INTERNAL COMBUSTION ENGINE

FIELD OF THE INVENTION

This invention concerns internal combustion engines and, more particularly, relates to an engine valve train mechanism with angulated intake valves and exhaust valves extending from a curved upper wall of the combustion chamber and having a cross member for actuating the intake and exhaust valves through a roller and groove arrangement.

BACKGROUND OF THE INVENTION

In the past, there have been various forms of valve trains proposed for multi-valve engines. One example can be seen in my U.S. Pat. No. 5,347,964, issued on Sep. 20, 1994 and entitled "Valve Train For Internal Combustion Engines". In this patent, I disclose a four-valve, double-overhead camshaft valve train in which the axes of the valves for each cylinder diverge outwardly from and are non-parallel with respect to the axis of the cylinder. The valve mechanism has a finger follower for each camshaft lobe and valve and a contact pad between the cam and the finger follower to permit rocking movement so that the orientation of the finger follower and the axis of the valve remain at a fixed relationship.

Also, in my U.S. Patent Application Ser. No. 08/416,245 filed on Apr. 4, 1995, now U.S. Pat. No. 5,570,665, and entitled "Valve Train For Internal Combustion Engine", I disclose a valve train utilizing an inverted bucket tappet with a slide-pivot or rotular structure operatively disposed between the bucket and the end of the valve stem allowing the valves to be angulated with respect to each other and to the axis of the cylinder in both the transversal and horizontal planes of the engine.

Another example of a valve train for a multi-valve engine can be seen in U.S. Pat. No. 4,558,667, issued on Dec. 17, 1985 in the name of Inagaki et al. and entitled "Valve Driving Apparatus For An Internal Combustion Engine". This patent discloses a valve driving apparatus incorporated in an internal combustion engine that has plural valve stems in a cylinder head that are aligned radially about the cylinder with the intersection of their longitudinal axes substantially coinciding with a center of curvature of an upper wall surface of the combustion chamber. The valve stems are arranged so as to be driven by at least one camshaft through subsidiary rocker arms which are in abutment with respective heads of the valve stems and respective rocker arms which are in abutment with the subsidiary rocker arms. The valve train is characterized in that a shaft for each of the subsidiary rocker arms is positioned on a plane crossing a longitudinal axis of the corresponding one of the valve stems at a right angle and existing in a range of up-and-down stroke of the head of the same valve stem.

Another patent disclosing a valve train for a multi-valve engine is the U.S. Pat. No. 4,617,881, issued on Oct. 21, 1986 in the name of Aoi et al., and entitled "Actuating Mechanism For Multiple Valve Internal Combustion Engine". In this instance, there are two embodiments of valve arrangements that permit the use of a plurality of valves for a given combustion chamber while operating all of the valves through a camshaft arrangement. Some of the valves are operated directly by the cam lobes and others are operated by rocker arms. In addition, an embodiment discloses a two rocker arm arrangement for operating certain valves.

A still further disclosure of a valve train for a multi-valve internal combustion engine can be seen in U.S. Pat. No. 4,686,945, issued on Aug. 18, 1987 in the name of Inagaki et al., and entitled "Valve Structure For An Internal Combustion Engine". Inagaki et al. This patent shows an engine employing multiple valves which are mutually inclined. The valve actuating assembly disclosed includes two camshafts with primary rocker arms being driven by the camshafts and, in turn, drive secondary rocker arms. The secondary rocker arms are pivotally mounted about common shafts and extend to the valves. The common shafts are located between the valves.

SUMMARY OF THE INVENTION

The valve train mechanism according to the present invention is functionally similar to each of the valve trains described above in that it serves to actuate the valves of an engine. However, the valve train according to this invention differs structurally from the above patented arrangements in that it based on the use of a cross member, which in one embodiment of the present invention takes the form of a guided "T" bridge, and which serves to directly actuate an inverted bucket tappet through a roller and groove connection without any side thrust on the valve stem. In alternate embodiments of the present invention, the cross member is designed so that it can be stable without having a pin to guide movement as provided in the "T"bridge.

In the preferred form, the valve train mechanism made in accordance with the present invention is incorporated in a cylinder head of an internal combustion engine having hemispherical combustion chambers each of which has four valves the valve stems axes of which are essentially normal to the upper hemispherical surface of the combustion chamber. The valve train mechanism utilizes an in-block camshaft with regular tappets and push rods to operate the rocker arms. Alternatively, an in-head camshaft could be used to operate the rocker arms. In either case, the rocker arms actuate the valves through a cross member. In addition, the present invention is based on the combination of inverted bucket tappets inserted in between the cross member and the valves, rollers at the end of the cross member contacting the tappets, special shims on the tappets grooved to guide the cross member and prevent it from rotating on its own axis, and swivel joints located between the rocker arms and the cross members. The groove in the shims may be semi-spherical or have a flat surface angled to allow the additional valve lift as the roller moves in the groove. The rocker arms oscillate about a vertical plane which is transversal to the crankshaft centerline, and each pair of intake valves and exhaust valves operates on a plane transversal of the engine and which is also angled in the longitudinal plane with respect to the crankshaft centerline. Valve lash calibration can be realized by thickness-selectable shims on one of the valves and by an adjustment screw at the valve-end of the rocker arm.

Stated broadly, the new and improved valve train mechanism made in accordance with the present invention is incorporated in an internal combustion engine having a cylinder head fixedly mounted on an engine block provided with one or more cylinders each of which has a piston reciprocally supported therein along the axial center line of the associated cylinder. A hemispherical combustion chamber is provided in each of the cylinders of the engine and is defined by a recess in the cylinder head and the top of the piston. At least a pair of valves are located in the cylinder head and each of the valves is biased into a closed position by a spring and is inclined outwardly from the combustion chamber at substantially equi-angular orientation relative to the axial center line of the cylinder. An inverted bucket tappet is mounted in the cylinder head for reciprocal movement and is operatively associated with each of the valves at the upper end thereof. A rocker arm and a cross member are provided for moving each of the valves to an open position against the bias of the spring. In addition, a swivel connection is provided between the rocker arm and the cross member, and a roller and groove connection is provided between the cross member and the inverted bucket tappet. The arrangement is such that the roller and groove connection cooperates with the swivel connection for assuring that the cross member maintains a force applying connection with the inverted bucket tappet as the valve is moved between the open position and the closed position.

BRIEF DESCRIPTION OF THE DRAWINGS

The above and other features, objects and advantages of the present invention will be more apparent from the following detailed description when taken with the drawings in which:

FIG. 2 is a view partially in section of a portion of the cylinder head incorporating the intake valves of FIG. 1 and the valve train mechanism for actuating the valves in accordance with the present invention;

FIGS. 3, 3A, and 4 are sectional views taken on line 3—3, line 3A—3A, and line 4—4, respectively, of FIG. 2;

DETAILED DESCRIPTION OF THE DRAWINGS

Figure 1:
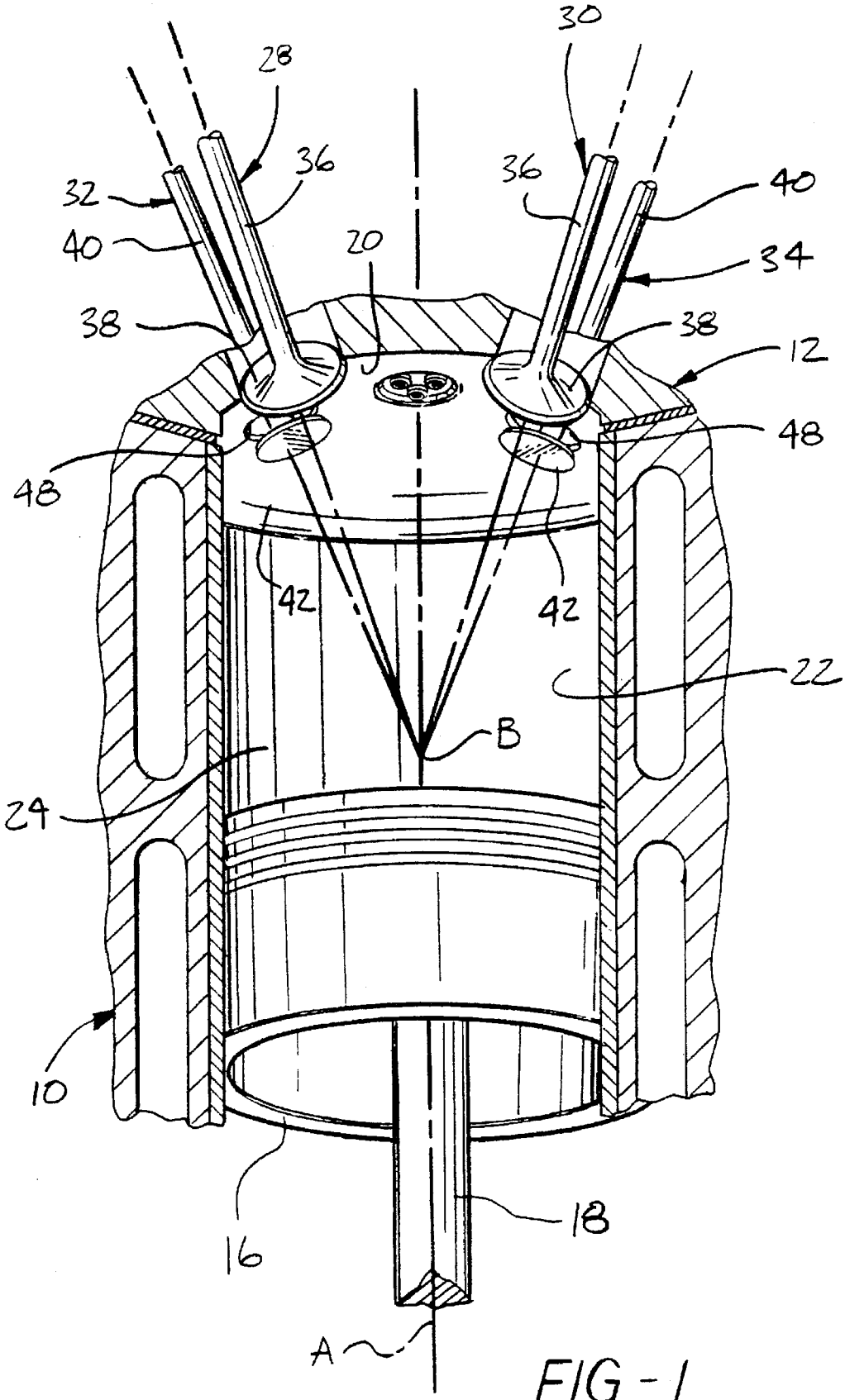
FIG. 1 is a perspective view of one cylinder of a multi-cylinder engine showing the pair of intake valves and the pair of exhaust valves which are actuated by a valve train mechanism made according to the present invention.

Referring now to the drawings and more particularly to FIG. 1 thereof, a perspective view of a single cylinder of a multi-cylinder engine is shown having an engine block 10 on which is secured by fasteners (not shown) a cylinder head 12 incorporating a valve train mechanism 14 made in accordance with the invention and seen in FIG. 2.

Each of the cylinders of the engine house a piston 16 which moves axially along the longitudinal center axis A of the associated cylinder and has the lower end thereof connected to the engine crankshaft (not shown) by a connecting rod 18. The cylinder head 12 is formed with a hemispherical surface 20 providing a recess which is aligned with the bore defining the associated cylinder 22 and together with the top of the piston 16 form a combustion chamber 24 which varies in volume during the operation of the engine. In this instance, a spark plug 26 is threadably secured in the cylinder head 12 centrally of the hemispherical surface or recess 20 along the longitudinal axis. "A" of each cylinder 22. As should be apparent, a fuel injector or a pre-combustion chamber could be substituted for the spark plug 26 when the valve train mechanism 14 according to the present invention is used with a compression ignition engine such as a diesel engine.

As best seen in FIG. 1, the cylinder head 12 is provided with a pair of intake valves 28 and 30 and a pair of exhaust valves 32 and 34 which are located in front and rear relationship. Each of the intake valves 28 and 30 has a valve stem 36 the lower end of which is formed with a round valve head Similarly, each of the exhaust valves 32 and 34 has a valve stem 40 the lower end of which is formed with a round valve head 42. As is conventional, each of the intake valve heads 38 are normally seated in a valve seat formed in the cylinder head that defines a round opening or port 44 of an intake passage 46 formed in the cylinder head 12 as seen in FIG. 2. Also, as seen in FIG. 1, each of the exhaust valve heads 42 are normally seated in a valve seat formed in the cylinder head 12 that defines a round opening or port 48 of an exhaust passage (not shown) formed in the cylinder head 12.

It will be noted that the valve stems 36 of the intake valves 28 and 30 and the valve stems 40 of the exhaust valves 32 and 34 are disposed radially about the cylinder head 12 such that the intersection of their longitudinal axes occurs at a point "B" located on the longitudinal center axis of the cylinder 22. As a result, the centers of the valve heads 38 of the intake valves 28 and 30 and the centers of the valve heads 40 of the exhaust valves 32 and 34 are located on a common circle concentric with the periphery of the cylinder 22. In addition, in this case, the centers of the valve heads 38 and 40 are circumferentially equally spaced from each other. Also, each of the valve heads 38 and 40 is in an essentially tangential plane relative to the hemispherical recess 20. Thus, as seen in FIG. 1, the longitudinal centerline of each valve 28–34 is canted at an equal angle to both the longitudinal and transversal planes of the engine. This orientation not only allows for more room at the top of the cylinder 22 and lessens the space requirements for valves, spark plugs, injectors or prechambers, but also produces a far superior combustion chamber with optimum central location of the spark plug or injector.

In order to simplify the description of the invention, the valve train mechanism 14 according to the present invention is shown in FIG. 2 employed with only the intake valves 28 and 30 of the engine as seen in FIG. 1. It will be understood that an essentially identical valve train mechanism would be employed with the exhaust valves 32 and 40 for opening and closing the ports 48 leading to the exhaust passages (not shown) formed in the cylinder head 12 of the engine. Moreover, inasmuch as the engine block, pistons, and the various operating components normally associated therewith are well known to those skilled in the art of engine design, a detailed showing and/or description of such parts and components is not being provided herein. Instead, the heart of the invention, namely the valve train mechanism 14, will now be described in detail.

As seen in FIG. 2, a camshaft 50 is rotatably supported in the engine block. The camshaft 50 includes a plurality of cam lobes (one of which is only shown and identified by reference numeral 52) for actuating the valves 28 and 30 through the overhead valve train mechanism 14. As the camshaft 50 rotates in timed sequence to the engine crankshaft (not shown), the cam lobe 52 causes upward movement of a main tappet 54 which is supported for sliding movement by the engine block. Disposed within the main tappet 54 is a ball and socket joint 56 having its ball portion integrally formed with the lower end of a pushrod 58. A similar ball and socket joint 60 is provided at the upper end of the pushrod 58 for connecting the pushrod 58 to one end of a rocker arm 62 which is supported for oscillation by a shaft 64 having its axis of rotation parallel to the axis of rotation of the camshaft 50.

As seen in FIGS. 2 and 4, the other end of the rocker arm 62 has an adjusting screw 66 threaded therein which is secured in place by a locknut 68 threadably received by the upper end of the screw 66. The lower end of the adjusting screw 66 is integrally formed with a ball member 70 which is located in a socket member 72 so as to provide a swivel joint (hereinafter referred to as "elephant foot") having a flat bottom surface 74 in contact with a hard wear pad 76 securely fixed to the top portion of a "T" bridge 78. The "T" bridge 78 has a body portion 80 supported for slidable up-and-down movement by a guide pin 82 the lower end of which is shown threadably secured in the cylinder head 12 but which preferably would be press-fitted in the cylinder head 12. The "T" bridge 78 is also formed with a cross member 84 the opposed ends of which are provided with roller members 86 and 88 each of which is supported by a shaft 90 for rotation about an axis which is perpendicular to a plane passing through the=longitudinal center axes of the valve stems of the valves 28 and. 30.

As seen in FIGS. 2 and 4, the longitudinal center axis of the guide pin 82 is parallel to a plane passing through the longitudinal center axes of the valve stems of the valves 28 and 30. Thus, the elephant foot consisting of the ball member 70 and the socket member 72 compensates for both the rocking motion of the rocker arm 62 on the "T" bridge 78 and for the angles formed between the two operating planes of the valve train mechanism 14; that is, the transversal plane "C" seen in FIG. 3A in which the rocker arm 62 oscillates and is perpendicular to the rotational axis of the rocker arm shaft 64, and the transversal plane "D" in which the two valves 28 and 30 and the "T" bridge 78 operate. The latter plane "D" is angled with respect to the rocker arm shaft 64 and therefore, during oscillation of the rocker arm 62, the socket member 72 of the elephant foot will slide sideways as seen in FIG. 4 relative to the wear surface 76 formed on the "T" bridge 78.

As seen in FIG. 2, the cylinder head 12 is formed with valve guides 92 and 94 which guide the valve stems 36 of the valves 28 and 30 through the course of motion between their fully-closed position and their fully-open position. In addition, each valve 28 and 30 is provided with a valve spring 96 which biases the associated valve into the fully-closed position. Each valve spring 96 has the upper end thereof engaging a disk type retainer 98 secured to the associated valve stem by a retainer lock 99 and has the lower end of the valve spring in contact with a flat surface of the cylinder head 12.

As seen in FIG. 2, the upper tips of the valve stems 36 of the valves 28 and 30 abut inverted bucket tappets 100 and 102, respectively, each of which is slidably disposed within a tappet guide formed as a structural extension of the cylinder head 12. The top of each of the inverted bucket tappets 100 and 102 is formed with a round shallow depression machined therein. Inserted within the depression formed in the inverted bucket tappet 102 is a disk type shim 104 having a flat upper surface which is contacted by the roller 88 of the "T" bridge 78. On the other hand, inserted within the depression formed in the inverted bucket tappet 100 is a disk type shim 106. Referring to FIGS. 3 and 5–7, disc 106 is provided with a groove 108 in which the roller 86 of the "T" bridge 78 is located.

Referring to FIGS. 2 and 3A, the shim 104 serves to provide a hard flat surface for the roller 88 as well as a means foe adjusting the lash of the valve system. The roller 88 contacts the top hard surface of the shim 104 and rolls on it as the "T" bridge 78 and the valves 28 and 30 reciprocate in unison and as the center distances of the valves change due to the transversal angularity between their respective axes of motion. Referring to FIGS. 2 and 3, the roller 86 located at the opposite end of the cross member 84 of the "T" bridge 78 contacts and rolls within the groove 108 formed in the shim 106. In this case the shim provides a wear control function by having a hard rolling surface for the roller 88. In addition, the shim 106 provides an anti-rotation function for the "T" bridge 78, i.e. the shim 106 prevents the "T" bridge 78 from rotating about the support pin 82. Thus, the groove 108 in shim 106 guides the roller 86 in its transversal motion and thereby prevents the "T" bridge 78 from rotating about the pin 82 and becoming disengaged from proper axial alignment with the operating plane intersecting the longitudinal center axes of the stems 36 of the valves 28 and 30.

Figure 5:
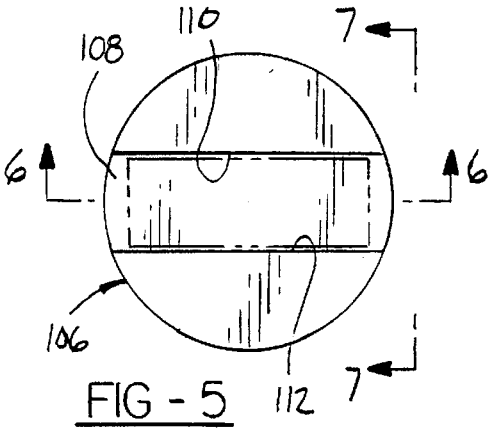
FIG. 5 is a view taken on line 5—5 of FIG. 3 showing one of the shims employed with one of the inverted bucket tappets associated with an intake valve.
Figure 6:
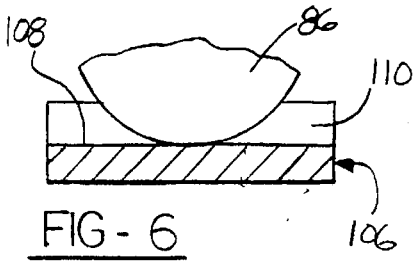
FIGS. 6 and 7 are views of the shim taken on line 6—6 and line 7—7, respectively, of FIG. 5.
Figure 7:
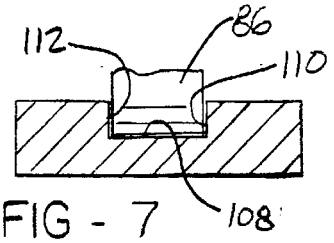

As seen in FIGS. 5–7, the groove 108 in the shim 106 is defined by a flat straight surface 108 and a pair of parallel side walls 110 and 112. The surface 108 of the groove 108 in the shim 106 is located in a plane that is perpendicular to the longitudinal center axis of the associated valve stem 36.

Figure 8:
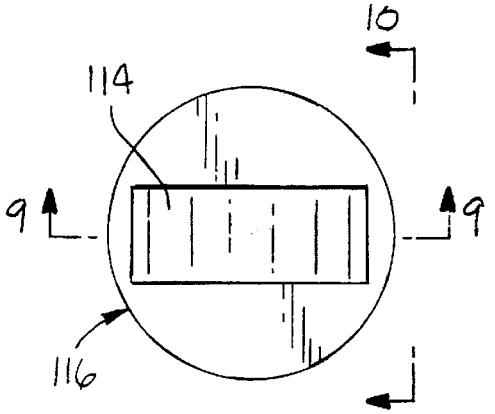
FIG. 8 shows a modification of the shim of FIGS. 5–7.
Figure 9:
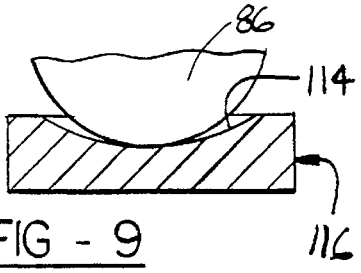
FIGS. 9 and 10 are views of the modified shim seen in FIG. 8 taken on line 9—9 and line 10—10, respectively.
Figure 10:
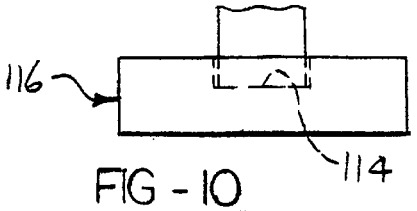

An alternative to the flat straight surface groove 108 in shim 106 as seen in FIGS. 5–7 can be an arcuate groove having an arcuate surface 114 such as seen in the shim 116 of FIGS. 8–10, The arcuate surface 114 has a radius that is larger than the radius of the associated roller. Thus, during operation of the valve train mechanism 14 employing the shim 116, as the "T" bridge 78 moves downward to open the valves 28 and 30, the roller 86 would move outboard relative to the tappet 100 and climb the ramp of the arcuate surface 114. As a result, increased valve lift would be obtained at the point of application without unduly stressing the mechanism at the point of lift initiation (the interface between the camshaft 50 and the main tappet 54).

Figure 11:
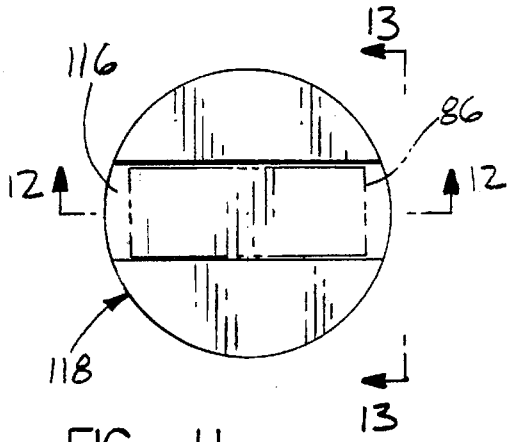
FIG. 11 shows a further modification of the shim of FIGS. 5–7.
Figure 12:
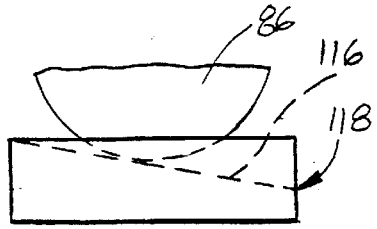
FIGS. 12 and 13 are views of the further modified shim seen in FIG. 11 taken on line 12—12 and line 13—13, respectively.
Figure 13:
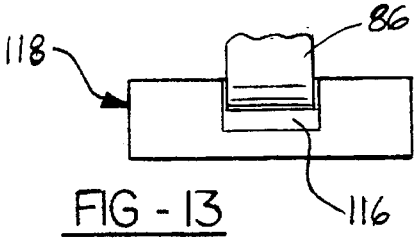

A somewhat similar lift multiplication as provided by the arcuate surface 114 seen in FIGS. 8–10 could be obtained by having a straight but angled ramp 116 formed in a shim 118 as seen in FIGS. 11–13. By having the shim 118 provided with a ramped lift multiplication arrangement and if used with one valve only as seen in FIG. 2, the attendant valve would lift more and could thereby enhance air flow or swirl when incorporated with the air intake valves 28 and 30. Alternatively, if it were desired to have identical lift in both valves 28 and 30, identical ramped shims could be used on both inverted bucket tappets 100 102 of the valve train mechanism 14. Moreover, the straight ramped grooved shims 118 shown in FIGS. 11–13 could also lend themselves to radically different lifts on both intake valves 28 and 30 by reversing the direction of the ramps so when the valve opening motion of the "T" bridge 78 is imparted to the inverted bucket tappets, the roller 86 of the "T" bridge 78 could climb the ramp on one shim while the other roller 88 could start to descend the ramp of the other shim. This then would produce two totally different valve opening curves on opposed sides of the valve train mechanism 14. Again, this could be desirable where an engine designer wishes to vary air flow or swirl characteristics imparted by the air intake valves 28 and 30.

The valve train mechanism 14 described above is preferably adjusted for proper valve setting (lash) by using one thickness only of the wear pad on the left or pilot side, as seen in FIG. 2, of the "T" bridge 78 and selecting the thickness of the shim 104 on the right side until the lash or gap between the wear pad of shim 104 and the roller 88 is within pre-established dimensions. This then sets both valves 28 nd 30 to begin operation only with a few thousands of an inch of lift from each other. Afterwards, the main setting between the bottom of the elephant foot and the top of the hard pad 76 is set also to the specified lash by adjusting the screw 66 and locking it in position with the locknut 68.

Figure 14:
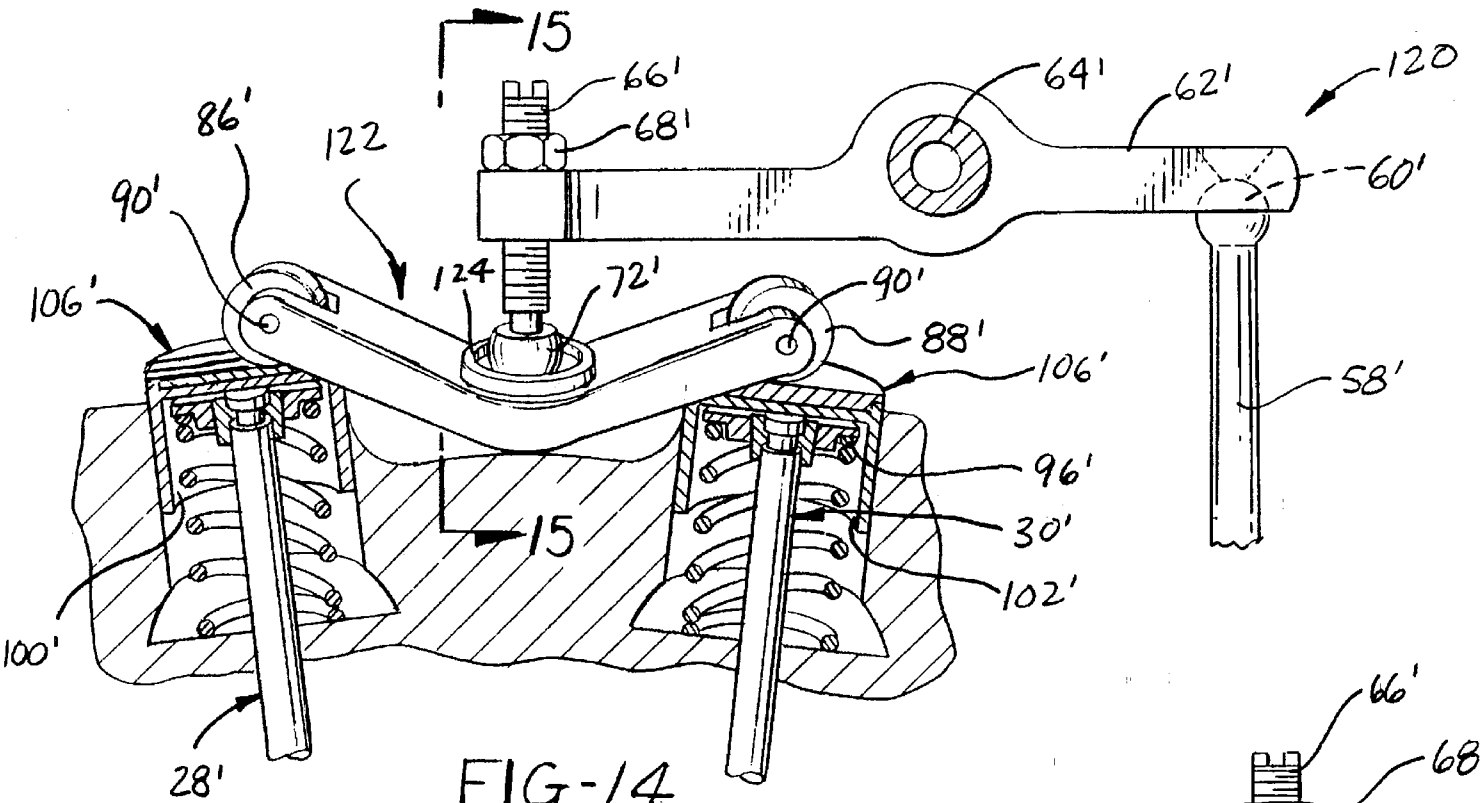
FIG. 14 is a view partially in section showing another form of cross member employed with the valve train mechanism according to the present invention.
Figure 15:
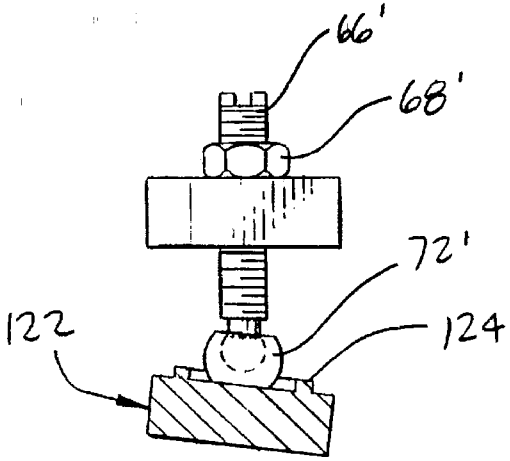
FIG. 15 is a sectional view taken on line 15—15 of FIG. 14.

FIGS. 14 and 15 show a valve train mechanism 120 that is the same as the valve train mechanism 14 of FIG. 2 except that it has a modified form of the cross member. Accordingly, parts of the valve train mechanism 120 seen in FIG. 14 and 15 that correspond to the parts of the valve train mechanism 14 of FIG. 2 will be identified by the same reference numerals but primed.

As seen in FIGS. 14 and 15, a rocker arm 62' is supported for pivotal movement by a shaft 64' one end of which is connected by a ball and socket arrangement 60' to a push rod 58'. As with the valve train mechanism 14 of FIG. 2 but not shown in the drawing, the lower end of the push rod 58' is connected through a ball and socket arrangement to a main tappet which contacts a camshaft. The other end of the rocker arm 62' is provided with an elephant foot in contact with the mid-section of a cross member 122 which includes a pair of rollers 86' and 88' each of which is supported for rotation by a shaft 90'. The socket member 72', which forms a part of the elephant foot, has its flat lower surface located within a circular area surrounded by a circular wall 124 having a diameter greater than the diameter of the socket member 72'. In addition, in this case each of the rollers 86' and 88' is located within a groove formed within the associated shim 106' carried by the inverted bucket tappets 100' and 102' which contact the valve stems of the intake valves 28' and 30'.

It should be apparent from the above description, that the major difference between the valve train mechanism 14 of FIG. 2 and the valve train mechanism 120 seen in FIGS. 14 and 15 is the fact that the cross member 122 is not guided by any pin or other structural member such as a fork during actuation by the rocker arm 62'. This is possible by having each of the rollers 86' and 88' located in a groove formed, as seen in FIGS. 5–7, in the associated shim 106', and having the center contact point of the lower surface of the socket member 72' positioned below a line connecting the center axes of the two shafts 90' supporting rollers 86' and 88'. It is also important to have the circular wall 124 formed at the mid-section of the cross member 122 define an area which allows the cross member 122 to move relative to the socket member 72' along the longitudinal axis of the engine and also allows the socket member 72' to move transversely to such axis, as seen in FIG. 14, while being actuated by the rocker arm 62'.

Figure 16:
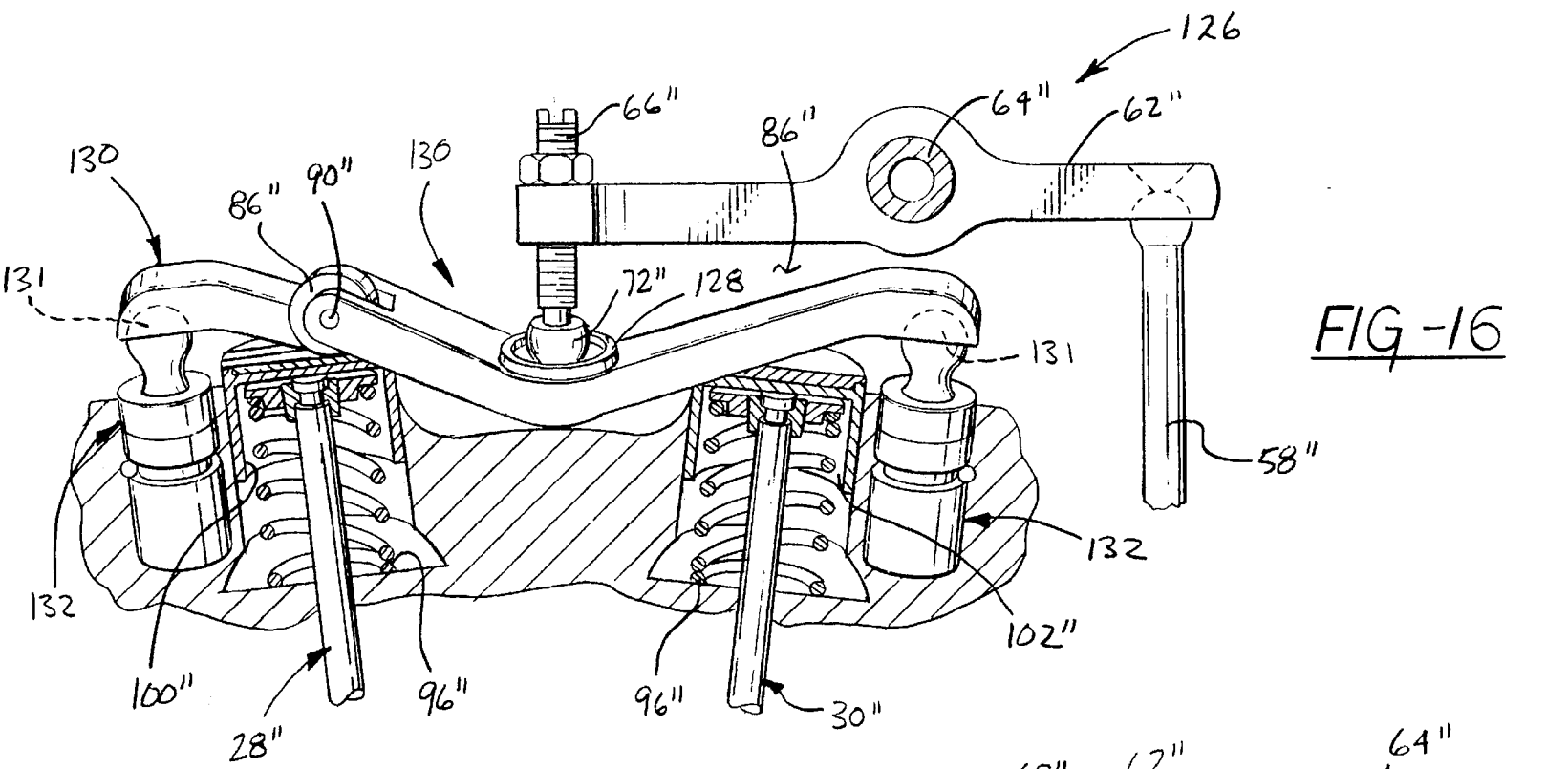
FIG. 16 is a view partially in section of another form of the valve train mechanism according to the present invention.
Figure 17:
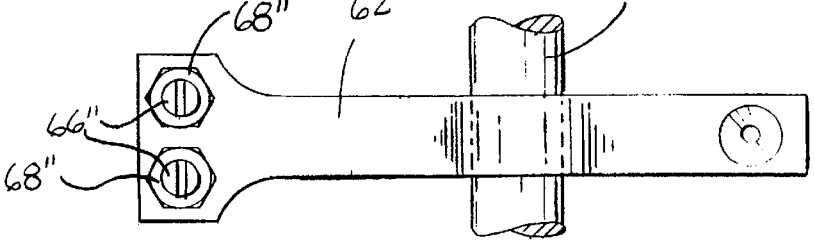
FIG. 17 is a top view of the rocker arm employed with the valve train mechanism of FIG. 16.

FIGS. 16 and 17 show another form of the present invention suitable for hemispherical combustion chambers with four overhead valves the valve stems of which preferably intersect a point "B" as seen in FIG. 2. As with the valve train mechanism 120, the parts of the valve train mechanism 126 seen in FIGS. 16 and 17 that correspond to the parts of valve train mechanism 14 will be identified by corresponding reference numerals but will, in this case, be double primed. A further difference between this valve train mechanism 126 and the valve train mechanism 14 is that each pair of the air intake valves 28" and 30" and each pair of the exhaust valves 32" and 34" (not shown) operate, in this instance, on a plane slightly angled with respect to a transversal plane which is perpendicular to the longitudinal axis of the engine. Also, only the exhaust valves 28" and 30" are shown in FIGS. 16 and 17 it being understood that a similar valve train mechanism would be provided for the exhaust valves.

As seen in FIG. 16, the main camshaft, main tappet, and lower part of a pushrod 58" are not shown and would be the same as provided with the valve train mechanism 14 of FIG. 2. The pushrod 58" is connected to one end of a rocker arm 62" which, in this case, is similar in construction to the rocker arm 62' of the valve train mechanism 14 of FIGS. 2–4 except that, as seen in FIG. 17, the end of the rocker arm 62" is widened and supports two adjustment screws (each identified by reference numeral 66") the lower end of each of which is provided with an elephant foot (one of which is only shown). The two elephant feet associated with the adjustment screws 66", 66" each contact the flat surface of a wear pad 128 fixed to a finger follower or cross member 130. Thus, two identical and separate finger followers 130 are provided side-by-side one end of each of which is provided with a roller 86" rotatably supported by a shaft 90". The other end of each finger follower 130 is pivotally supported by a ball portion 131 which forms a rigid part of a base 132 secured to the cylinder head. Also, each of the rollers 86" is located in a groove formed in the associated shim 106" mounted on the associated inverted bucket tappet which is in contact with the valve 28" and 30" normally biased in the closed position by a spring 96".

As in the case with the cross member 122 incorporated with the valve train mechanism 120 seen in FIGS. 14 and 15, each of the finger followers 130 is designed so that the center of the flat bottom surface of the elephant foot's socket member 72" is located below a line connecting the center of the shaft 90" supporting the associated roller and the center of the ball portion 131.

From the above description, it should be apparent that as the rocker arm 62" is pivoted in a counter-clockwise direction about the rocker shaft 64" as seen in FIG. 16, both of the finger followers 130 are caused to pivot downwardly about their ball portion 131 with the rolling action of the associated roller 86" causing a downward movement of the associated inverted bucket tappet. This action then results in an opening of the associated valve against the bias of the associated spring 96". Moreover, during opening of the valves 28" and 30", the fore and aft along the longitudinal axis of the engine as well as transverse movement of the roller end of an associated finger follower is permitted by the associated elephant foot.

It will be understood that, the valve train arrangement 120 seen in FIGS. 16 and 17 could be used in an engine having hemispherical combustion chambers provided with two valves (one exhaust valve and one intake valve) rather than four valves per cylinder. In such case the rocker arm would support a single elephant foot rather than two and operate only one finger follower associated with either the exhaust valve or air intake valve. A similar arrangement than would be used for actuating the other valve of the two valve per cylinder engine.

Various changes and modifications can be made to the above described valve train mechanism without departing from the spirit of the invention. Such changes are contemplated by the inventor and he does not wish to be limited except by the scope of the appended claims.

The embodiments of the invention in which an exclusive property or privilege is claimed are defined as follows:

1. A valve train mechanism for an internal combustion engine having a cylinder head fixedly mounted on an engine block provided with one or more cylinders each of which has a piston reciprocally supported therein along the axial center line of the associated cylinder, a hemispherical combustion chamber in each of said cylinders of said engine and being defined by a recess in said cylinder head and the top of said piston, at least a pair of valves located in said cylinder head, each of said valves being biased into a closed position by a spring and being inclined outwardly from said combustion chamber at substantially equiangular orientation relative to said axial center line and having an inverted bucket tappet mounted on the upper end thereof, a rocker arm and a cross member for moving said pair of valves to an open position against the bias of said spring, a ball and socket connection located between said rocker arm and said cross member, and at least one roller and groove connection between said cross member and one of said inverted bucket tappets cooperating with said ball and socket connection for assuring that said cross member maintains a force applying connection with said inverted bucket tappet as said pair of valves move between said open position and said closed position.

2. The valve train mechanism of claim 1 wherein said cross member has one end thereof supported for pivotal movement by said cylinder head and has the other end thereof provided with a roller located in a groove formed in the associated inverted bucket tappet.

3. The valve train mechanism of claim 2 wherein said one end of said cross member is supported by a ball portion mounted in said cylinder head, and said roller and groove connection including a roller rotatably supported by a shaft at the other end of said cross member whereby the center of the contact point between said ball and socket connection and said cross member is located below a line passing through the center of said shaft and the center of said ball portion.

4. The valve train mechanism of claim 1 wherein said cross member is part of a "T" bridge having a body portion supported for reciprocal movement by a guide pin secured to said cylinder head between said pair of valves.

5. The valve train mechanism of claim 4 wherein the longitudinal center axis of said guide pin is located in a plane passing through the longitudinal axes of said pair of valves.

6. A valve train mechanism for an internal combustion engine having a cylinder head fixedly mounted on an engine block provided with one or more cylinders each of which has a piston reciprocally supported therein along the axial center line of the associated cylinder, a hemispherical combustion chamber in each of said cylinders of said engine and being defined by a curved recess in said cylinder head and the top of said piston, a pair of exhaust valves and a pair of intake valves located in said cylinder head, each of said pair of exhaust valves and each of said pair of intake valves being inclined outwardly from said combustion chamber at substantially equi-angular orientation relative to said axial center line and having an inverted bucket tappet mounted on the upper end thereof, a first cross member for moving said pair of exhaust valves between open and closed positions and a second cross member for moving said pair of intake valves between an open position and a closed position, a first rocker arm for actuating said first cross member and a second rocker arm for actuating said second cross member, a swivel connection located between each of said rocker arms and cross members, said first cross member and said second cross member each having a roller and groove connection with at least one of the inverted bucket tappets of the associated pair of valves and cooperating with the associated swivel connection for assuring that the cross member moves in a plane passing through the longitudinal center axes of the valve stems of said associated pair of valves so as to maintain the cross member in proper alignment with the associated valves during the actuation thereof by the associated rocker arm.

7. The valve train mechanism of claim 6 wherein said roller and groove connection is provided at each end of said first and second cross members for cooperation with an associated inverted bucket tappet.

8. The valve train mechanism of claim 7 wherein said roller and groove connection consists of a roller mounted for rotation on a shaft at each end of said first and second cross members and a groove formed in the associated inverted bucket tappet.

9. The valve train mechanism of claim 8 wherein the center of the contact point between said swivel connection and an associated cross member is located below a line passing through the centers of the shafts supporting the rollers at the opposed ends of said associated cross member.

10. A valve mechanism for an internal combustion engine having a cylinder head fixedly mounted on an engine block provided with one or more cylinders each of which has a piston reciprocally supported therein along the axial center line of the associated cylinder, a combustion chamber in each of said cylinders of said engine and being defined by a curved recess in said cylinder head and the top of said piston, said valve mechanism comprising a pair of exhaust valves and a pair of intake valves located in said cylinder head, each of said pair of exhaust valves and each of said pair of intake valves being inclined outwardly from said combustion chamber at substantially equi-angular orientation relative to said axial center line and having an inverted bucket tappet mounted on the upper end thereof, one of the tappets of said pair of exhaust valves and one of the tappets of said pair of intake valves having a groove formed therein, a first cross-member for moving said pair of exhaust valves between an open position and a closed position and a second cross member for moving said pair of intake valves between open and closed positions, a first rocker arm for actuating said first cross member and a second rocker arm for actuating said second cross member, a swivel connection located between each of said rocker arms and associated cross member, said first cross member and said second cross member each having a first end and a second end and having each of said ends supporting a roller for operatively engaging the tappets of the associated pair of valves, the arrangement being such that one of the rollers of each of said cross members is located in said groove in one of the tappets and cooperates therewith for maintaining said cross member in proper alignment with the associated valves during the actuation thereof by the associated rocker arm.

* * * * *